United States Patent [19]

Miller

[11] Patent Number: 4,624,490

[45] Date of Patent: Nov. 25, 1986

[54] EXIT DEVICE FOR A DOOR

[75] Inventor: Theodore H. Miller, New Britain, Conn.

[73] Assignee: Emhart Industries, Inc., Farmington, Conn.

[21] Appl. No.: 535,509

[22] Filed: Sep. 26, 1983

[51] Int. Cl.[4] ..... E05C 15/02

[52] U.S. Cl. ..... 292/92; 70/92; 292/336.3

[58] Field of Search ..... 292/21, 92, 93, 336.3; 70/92

[56] References Cited

U.S. PATENT DOCUMENTS

| | | | |
|---|---|---|---|
| 3,614,145 | 10/1971 | Zawadzki | 292/92 |
| 3,877,262 | 4/1975 | Williams | 292/92 X |
| 4,083,590 | 4/1978 | Folger | 292/92 |
| 4,384,738 | 5/1983 | Floyd | 292/92 |

*Primary Examiner*—Richard E. Moore

*Attorney, Agent, or Firm*—Barry E. Deutsch

[57] ABSTRACT

An exit device for a door includes a rear channel member, a latch bolt assembly at one end of the channel member, a pair of spaced rails mounted in the rear channel member, with the channel member including two sets of opposed longitudinally extending grooves in its interior forming tracks for the rails. The rails are mounted in the tracks. A path bar includes a portion extending outwardly of the channel member. At least one connecting link is pivotably attached at one end to the rails and pivotably attached at the other end to the push bar for mounting the push bar in the channel for movement between a retracted position and a depressed position. The push bar has tapered end portions tapering outwardly toward the latch bolt assembly. The exit device further includes a cover including an end portion adjacent the push bar and having a taper complementary to the taper on the adjacent end of the push bar. The exit device further includes a skirt member mounted in the rear channel member and extending from the push bar to the end of the rear channel member opposite to the latch bolt assembly. The skirt has a taper at its end adjacent the push bar complementary to the taper on the adjacent end of the push bar.

20 Claims, 12 Drawing Figures

EXIT DEVICE FOR A DOOR

BACKGROUND OF THE INVENTION

The present invention relates generally to the field of exit devices for doors and the like. More particularly, the present invention relates to an exit device of the type which utilizes a push bar and is adapted to be mounted on the surface of the door.

One prior art device of this general type of exit device utilizes a push bar which is pivotally mounted for movement during its extended and depressed positions. With this type of device, the inner pivot pin is attached to the sidewalls of a channel member presenting assembly problems due to a need for aligning the openings in the sidewall channel and the pivot axis of the connecting link. In addition, with the type of device wherein the push bar has arcuate movement during depression, the push bar moves relative to the cover of the latch bolt assembly and a gap forms therein which forms a potential pinch point.

Devices of this type may also include a push bar which does not extend the entire length of the channel with a skirt or cover member being provided between the end of the push bar opposite the latch bolt assembly and the channel member. As the push bar has a portion extending outwardly from the channel, these prior art devices have relatively sharp angles for presenting a possible catch point for objects or clothing. Also in prior art devices, it is known to provide dogging devices to maintain a push bar in its depressed position whereby the latch bolt is retracted and the door can be readily opened and closed. However, it is relatively difficult to change from one type of dogging device to another, for example, one utilizing a key operated lock cylinder or one that simply uses a hex key.

SUMMARY OF THE INVENTION

In view of the above, it is one object of the present invention to provide an improved exit device for a door.

A more specific object of the present invention is an exit device in which the assembly of the pivot pins is relatively easy and the pivot pins are contained within the sidewalls of the channel.

Another object of the present invention is the provision of an exit device wherein when the push bar is depressed, the space between the cover and the adjacent end of the push bar as well as between the push bar and end cap remain relatively small.

It is a further object of the present invention to provide an exit device having no sharp angles for objects or clothing to catch on.

Still another object of the present invention is to provide an improved dogging arrangement to maintain the push bar in its depressed position to permit the door to be opened at will.

Yet another object of the present invention is to provide means for positive positioning of a skirt member.

According to one feature of the present invention, the exit device may comprise a rear channel member having a latch bolt assembly at one end thereof. A pair of spaced rails are mounted in the channel member. A push bar, having a portion extending outwardly from the channel member, may be provided with at least one connecting link pivotally attached at one end to the rails and pivotally attached at the other end to the push bar for mounting the push bar in the channel for movement between a retracted position and a depressed position.

There are means interconnecting the push bar and latch bolt assembly to operate said latch bolt assembly when the push bar is moved.

According to another feature of the invention, the exit device may include a rear channel member, a latch bolt assembly at one end of the channel member provided with a cover. The push bar is mounted in the channel and has a portion extending outwardly therefrom. Means are provided to connect said push bar to said channel member for arcuate movement of said push bar relative to said channel member between an extended position and a depressed position. The push bar extends longitudinally from the cover the partial length of said rear channel member. A skirt member is mounted in the rear channel member adjacent the open area therein and extends from the push bar to the end of the rear channel member opposite the latch bolt assembly. The push bar has tapered end portions tapering outwardly and toward the latch bolt assembly. The cover of the latch bolt assembly includes an end portion adjacent the push bar having a taper complimentary to the taper on the adjacent end of the push bar. A skirt has a taper at its end adjacent the push bar complimentary to the taper on the adjacent end of the push bar. An end cover is provided on the end of the rear channel member opposite the latch assembly.

Still another feature of the present invention is the provision of an exit device which comprises a rear channel member and a latch bolt assembly at one end thereof. A push bar is mounted in the channel member for movement between an extended position and a depressed position. Means are provided interconnecting the push bar and the latch bolt assembly to operate the latch bolt assembly when the push bar is moved. The push bar extends from a point adjacent the latch assembly a partial length of the channel member. A skirt is slidably mounted in the channel member and extends from adjacent the push bar to the end of the channel member opposite the latch assembly. A stop member is mounted in the channel and has a stop surface for engagement by the end of the skirt adjacent the push bar. An end cover is provided covering the end of the channel member and said skirt opposite the latch bolt assembly.

A further feature of the present invention includes an exit device for a door comprising a rear channel member having a rear wall mounted against the surface of the door. A latch bolt assembly is provided at one end of the channel member and a push bar is mounted in the channel member for movement between an extended position and a depressed position. Means interconnect the push bar and the latch bolt assembly to operate the latch bolt assembly when the push bar is moved. The push bar extends from a point adjacent the latch assembly the partial length of the channel member. A skirt is slidably mounted in the channel member and extends adjacent the push bar to the end of said rear channel member opposite said latch assembly. A dogging bar is attached to the push bar and extends inwardly into the channel member and includes a latch engaging portion extending parallel to the rear wall of the channel member. A dogging device is mounted in skirt and extends inwardly in said channel member. The dogging device includes a latch portion extending parallel to the latch engaging portion. Means are provided for mounting the latch portion for movement between a first position wherein it is free of engagement of the latch engaging portion during movement of the push bar and a second position wherein, when the push bar is depressed, the latching portion is positioned outwardly in said channel member of said latch engaging portion and in overlapping engagement therewith.

According to still another feature of the present invention, an exit device for a door is provided which comprises a rear channel member having a rear wall adapted to be mounted against the surface of the door. A latch bolt assembly is provided at one end of the channel member. A push bar is mounted in the channel member for movement between an extended position and a retracted position. Means are provided for interconnecting said push bar and said latch bolt assembly to operate the latch bolt assembly when said push bar is moved. The push bar extends from a point adjacent said latch assembly a partial length of the channel member. A skirt is slidably mounted in said channel member and extends from adjacent said push bar to the end of the rear channel member opposite said latch assembly. A dogging bar is attached to said push bar and extends inwardly in the channel member and has a latch engaging portion extending parallel to the rear wall of said channel member. A lock cylinder is mounted in the skirt and extends inwardly in the channel member. A dogging cam is threaded onto the lock cylinder and includes a latch portion extending parallel to said latch engaging portion. A cylinder cam is mounted on the cylinder lock and is rotatable about an axis. Means are provided on the dogging cam for engagement by said cylinder cam upon rotation thereof in one direction to rotate said dogging cam on said cylinder in a first position where it is free of engagement of said latch engaging portion during movement of the push bar and upon rotation in another direction into a second position wherein when said push bar is retracted, said latch portion is positioned outwardly in said channel member of said latch engaging portion and in an overlapping engagement therewith.

DETAILED DESCRIPTION

Figure 1:
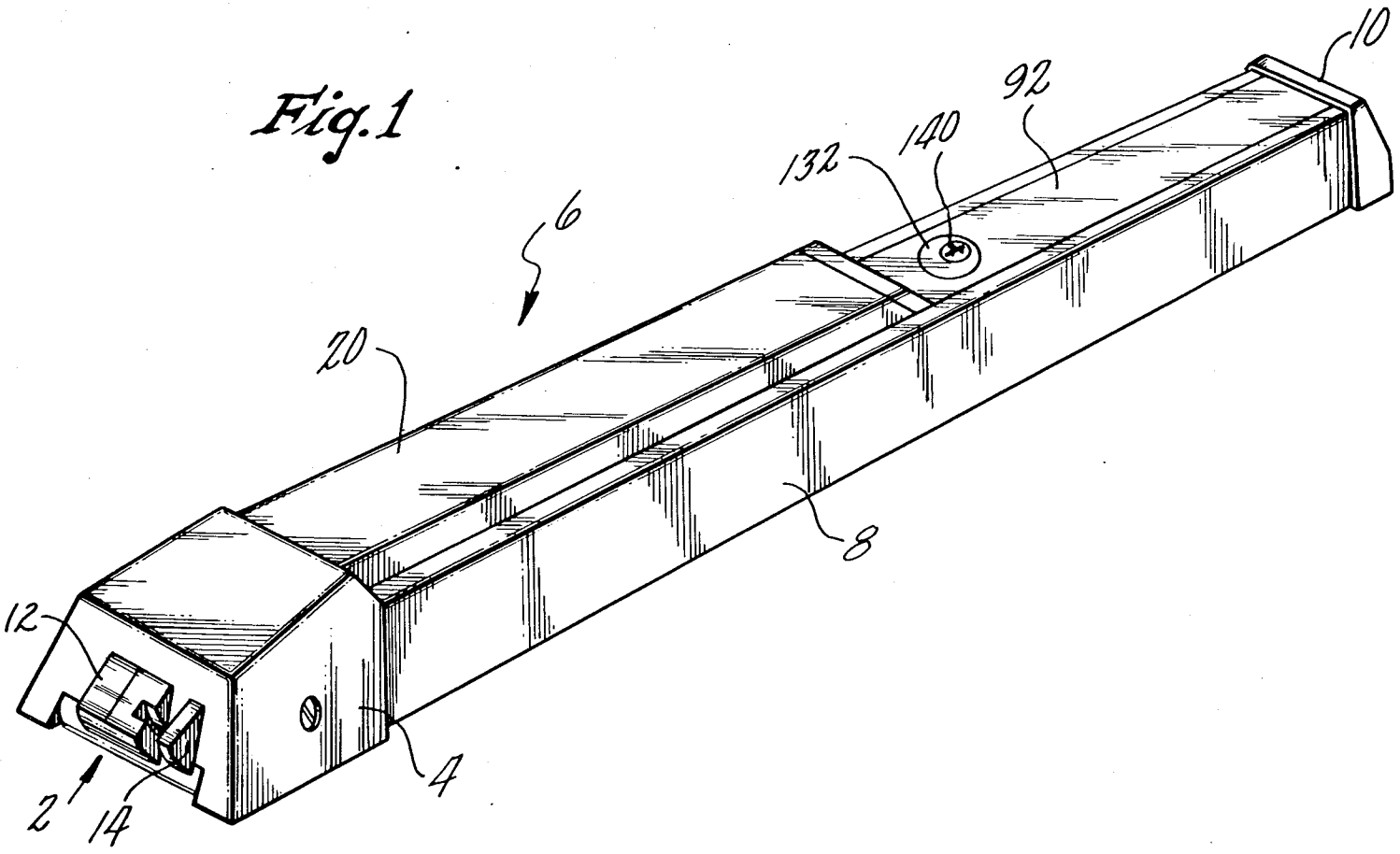
FIG. 1 is a perspective view of an exit device constructed in accordance with the present invention.

Referring to the drawings, and in particular FIG. 1, an exit device incorporating the present invention includes a latch bolt assembly 2 contained within a latch bolt cover 4. An actuating mechanism 6 is mounted in a rear channel member 8 which extends from the latch bolt cover 4 transversely of the door and has an end cap 10 provided at its end opposite the latch bolt assembly 2.

Figure 2:
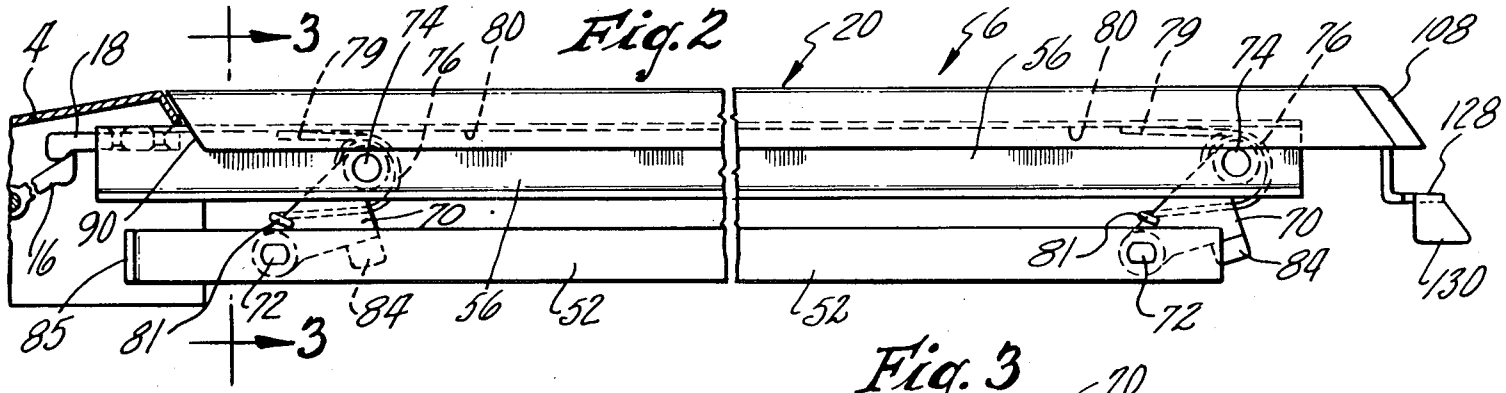
FIG. 2 is a side view of the actuating mechanism.

The latch bolt assembly 2 may be of the type disclosed in U.S. Pat. No. 3,877,262, issued Apr. 15, 1975 to Merton S. Williams, which patent is incorporated herein by reference in its entirety. Since the latch bolt assembly 2 does not form a part of the present invention and since it is described in detail in the above-mentioned U.S. patent, it is sufficient to state that the latch bolt assembly 2 may include a latch bolt 12 which extends outwardly from the end of the latch bolt cover 4 for engaging a strike assembly (not shown) mounted on the frame of the door in a conventional manner. The latch bolt assembly 2 may also include an auxillary bolt 14 which is used in connection with a deadlocking mechanism (not shown) in the manner described in U.S. Pat. No. 3,877,262 for deadlocking the latch bolt 12 when the door is closed and the latch bolt 12 is projected. The latch bolt assembly 2 further includes as shown schematically in FIG. 2, a retractor lever 16 adapted to be engaged by a retractor finger 18 mounted on a push bar 20 of the actuating mechanism 6 which serves to retract the latch bolt 12 when the push bar 20 is depressed. Although the embodiment disclosed herein shows the use of a latch bolt assembly 2 of the rim type, the present invention may also be used with latch bolt assemblies of the vertical rod type.

Figure 3:
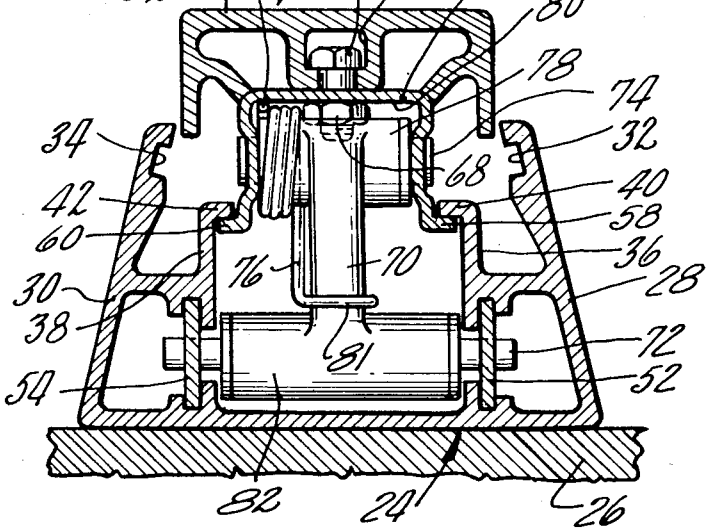
FIG. 3 is an enlarged cross-sectional view taken along the lines 3—3 of FIG. 2 and showing the actuating mechanism mounted in the rear channel member.
Figure 4:
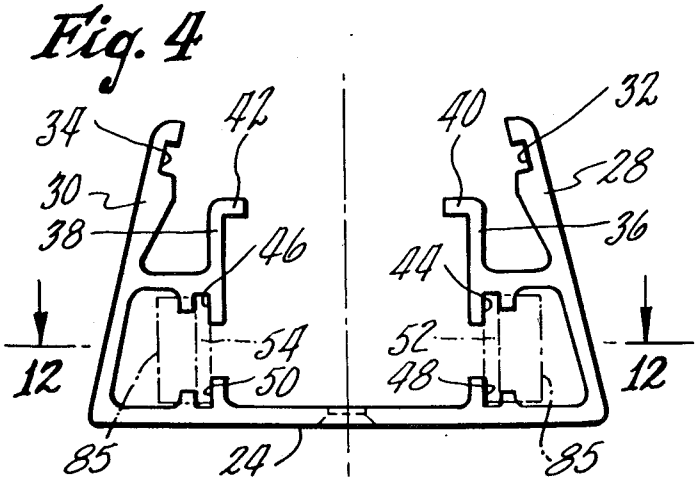
FIG. 4 is a detailed end view of the rear channel member.

The rear channel member 8 is secured to the mounting plate 22 of the latch bolt assembly 2 by a screw 23 and extends horizontally with its rearwall 24 positioned against the side of the door 26. The rear channel member 8 opens outwardly from its rearwall 24 and includes two sidewalls 28 and 30 which taper inwardly toward each other in the direction of the opening as shown in FIGS. 3 and 4. Longitudinal grooves 32 and 34 are formed in the inside of the sidewalls 28 and 30, respectively, near the opening of the rear channel member 8 and extend along the length thereof. Opposed L-shaped arms 36 and 38 extend from the sidewalls 28 and 30, respectively, within the rear channel member 8 and include spaced facing flanges 40 and 42 which extend the length of the rear channel member 8 parallel to the rear wall 24 thereof. The arms 36 and 38 have grooves 44 and 46 respectively formed therein, which face inwardly toward opposed grooves 48 and 50 formed in the rearwall 24.

The actuating assembly 6 is mounted in the rear channel member 8 and includes two rails 52 and 54 which are received in the tracks formed by the two sets of opposed grooves 44, 48 and 46, 50 as shown in FIG. 3. The push bar 20 includes a front channel 56 which opens inwardly in the rear channel member 8 and includes flanges 58 and 60 at the ends of the side wall thereof facing away from each other. The flanges 58 and 60 extend longitudinally for the length of the front channel 56 and are positioned inwardly of the flanges 40 and 42 respectively of the rear channel member 8. A front cover 62 is attached to the front channel 56 by means of one or more bolts 64 positioned in a longitudinally extending T-slot opening 66 in the inner side of the front cover 62 with nuts 68 threaded thereon into engagement with the inner side of the T-slot opening 66. The front cover 62 has a width slightly smaller than the width of the opening into the rear channel member 8 to provide clearance between the two members.

The push bar 20 is connected to the rails 52 and 54 by means of connecting links 70. One end of each of the connecting links 70 is mounted on a pivot pin 72 which extends through the rails 52 and 54. The other end of each of the connecting links 70 is connected to the front channel 56 of the push bar 20 by means of a pivot pin 74 which extends through the sidewalls of the front channel 56 as shown in FIG. 3. Each of the connecting links 70 has a torsion spring 76 associated therewith wrapped around the outer portion 78 of the connecting link 70 through which the pivot pin 74 passes with one leg 79 of the torsion spring 76 engaging the inside of the front wall 80 of the front channel 56 and the other leg 81 wrapped around the body of the connecting link 70 adjacent the inner portion 82 thereof which is mounted on the pivot pin 72.

The torsion spring 76 serves to bias the push bar 20 into its extended position at which point the flanges 58 and 60 on the front channel 56 engage the inner side of the flanges 40 and 42 on the rear channel member 8 to limit the outward movement of the push bar 20. A stop 84 is provided on each connecting link 70 to engage the inside of the rear wall 24 of the rear channel member 8 when the push bar 20 is depressed to limit the inward movement thereof.

Each of the rails 52 and 54 have their end portions adjacent the bolt assembly bent at right angles to form flanges 85 which engage the end of the portion of the rear channel member 8 which forms their respective tracks 44, 48 and 46, 50. The mounting plate 22 of the latch bolt assembly 2 includes two opposed edges 86,88 which engage the forward face of the flanges 85 on the end of the rails 52 and 54 respectively such that the rails 52 and 54 are contained between the mounting plate 22 and the end of the rear channel member 8 whereby movement of the rails 52 and 54 in their tracks is prevented.

With the above described arrangement, when a slight pressure is exerted upon the push bar 20 in an inward direction or toward the door 26, the push bar 20 is caused to pivot or move in an arcuate direction about the lower pivot pins 72 whereby the push bar 20 moves inwardly in the rear channel member 8 and in a direction away from the latch bolt assembly 2. In doing so, the retractor finger 18 engages and pivots the retractor lever 16 causing the latch bolt 12 to be retracted, as more fully explained in the aforesaid U.S. Pat. No. 3,877,262.

In assembling the actuating assembly 6 in the rear channel member 8 and assuming that the connecting links 70 are connected to the push bar 20 by means of the pivot pins 74, then the rails 52 and 54 mounted may be mounted on the ends of the pivot pins 72 which have been inserted in their openings in the connecting links 72. The actuating asssembly 6 can then be mounted in the rear channel member 8 by depressing the push bar 20 relative to the rails 52 and 54 so that the flanges 58 and 60 on the front channel 56 will be positioned inwardly of the flanges 40 and 42 in the rear channel member 8. By aligning the rails 52 and 54 with their respective tracks 44, 48 and 46, 50, the actuating assembly 6 may be slid into the rear channel member 8, from the latch bolt assembly end thereof.

It will be noted that the pivot pins 72 do not extend through the sidewalls 28 and 30 of the rear channel member 8, thereby eliminating any alignment problem which would be associated with inserting a pivot pin through an opening in one of the sidewalls 28 and 30 and through the opening in the connecting link. Also, since the pivot pins 70 are contained within the rear channel member 8, a more aesthetic appearance is obtained since the sidwalls are not interrupted. It will also be noted that the front channel 56 and cover 62 are so dimensioned that, when the push bar 20 is in its extended position, the sidewalls of the cover 20 extend into the rear channel member 8, hiding the front channel 56 from view.

Figures 5, 6, 7, 8, 9:
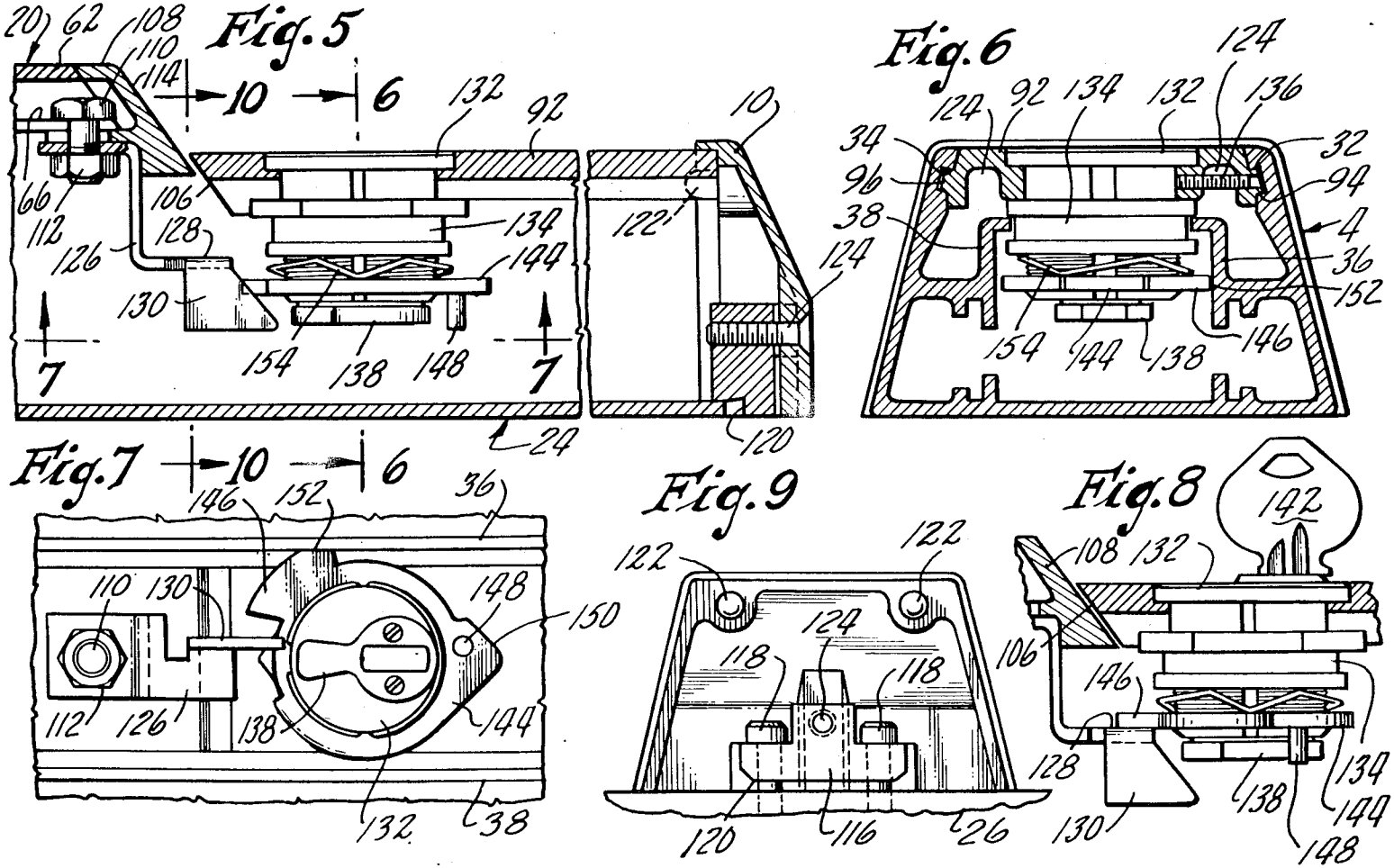
FIG. 5 is a fragmentary cross-sectional view of the end portion of the exit device opposite latch assembly and showing the cylinder dogging device.
FIG. 6 is a cross-sectional view taken along the lines 6—6 of FIG. 5.
FIG. 7 is a view of the dogging device taken along the lines 7—7 of FIG. 5.
FIG. 8 is a fragmentary cross-sectional view similar to FIG. 5, but showing the dogging device shown in the dogging position.
FIG. 9 is a view of the end cap showing its mounting means.
Figure 10:
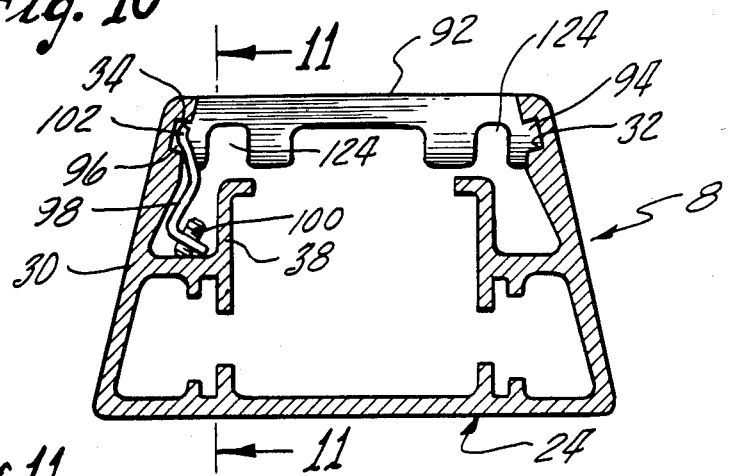
FIG. 10 is a cross-sectional view showing the stop means for the skirt taken along the lines 10—10 of FIG. 5.
Figure 11:
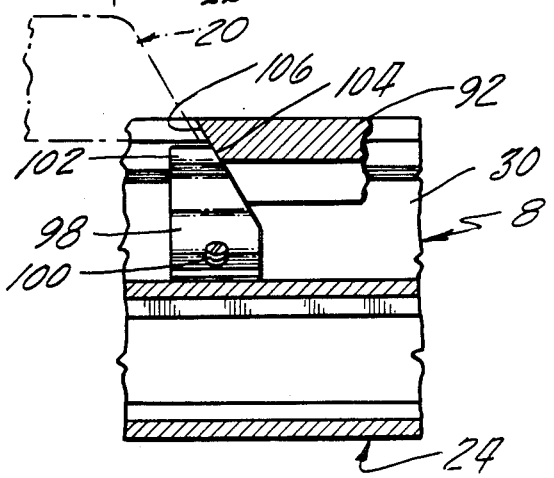
FIG. 11 is a view of the stop means taken along the lines 11—11 of FIG. 10.
Figure 12:
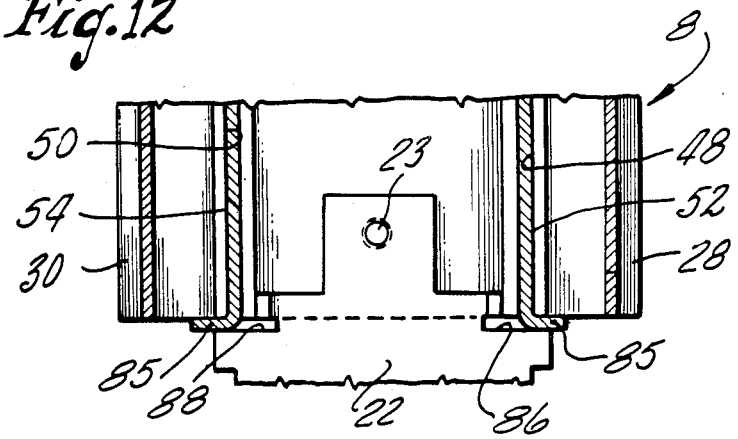
FIG. 12 is a horizontal cross-sectional view showing the positioning means for the operating mechanism taken along the lines 12—12 of FIG. 11.

The actuating assembly 6 extends a predetermined distance in the rear channel member 8 from the latch bolt assembly 2. The front cover 62 of the actuating assembly 6 terminates in a tapered end portion 90 which tapers outwardly and forwardly towards the latch bolt assembly 2. A skirt or cover plate 92 having longitudinally extending flanges 94 and 96 on its opposed side portions is mounted in the rear channel member 8 with the flanges 94 and 96 of the skirt 92 being received in the grooves 32 and 34 in the rear channel member 8 respectively as shown in particularly in FIG. 6. The skirt or cover plate 92 extends from the end cap 10 toward the latch bolt assembly 2 until it abuts a skirt stop 98, thereby completing the closing of the rear channel member 8 in conjunction with the end cap 10 and the actuating assembly 6. The skirt stop 98 is mounted in the rear channel 8 between the arm 38 and the sidewall 30 thereof and is held in place by means of a set screw 100. The skirt stop 98 includes a portion 102 which extends outwardly of the rear channel member 8 into the groove 34 and also includes a stop surface 104 which tapers outwardly towards the latch bolt assembly 2 to match the tapered end portion 106 on the end of the skirt 92. The push bar 20 includes an end cover 108 which is attached to the front cover 62 by means of a bolt 110 mounted in the T-shaped slot 66 and nut 112 as shown in FIG. 5. The end of the end cover 108 facing the skirt 92 has a tapering surface 114 complimentary to the taper on the end of the skirt 92.

A mounting block 116, shown in FIG. 5 and 9, for the end cap 10 is attached to the door 26 by means of screws 118 and includes a recessed portion 120 in which a portion of rearwall 24 of the rear channel member 8 is received. The end cap 10 includes nubs 122 which are positioned in longitudinal channels 124 in the inside of the skirt 92 when the end cap 10 is mounted on the rear channel member 8 and is secured to the mounting block 116 by means of a screw member or the like 124.

In assembling the device, the skirt 92 is inserted into the channel member 8 until its tapered end abuts the stop surface 104 of the skirt stop 98. The skirt stop 98 prevents movement of the skirt 92 toward the push bar 20 and prevents binding therebetween. The end cap 10 prevents movement of the skirt 92 in a direction away from the push bar 20.

With the above arrangement, it will be noted that the push bar 20 does not extend the entire length of the rear channel member 8, and that the remainder of the rear channel member is covered by the skirt 92. Thus, the channel member 8 and skirt 92 may be cut in the field according to the width of the door. Thus, the use of the skirt 92 results in a minimum number of different lengths of exit devices that must be stocked.

As mentioned above, the push bar 20 is tapered at both its ends with both the cover 4 of the latch bolt assembly 2 and the skirt 92 having their end portion adjacent the push bar 20 complementarily tapered. With this arrangement, when the push bar 20 is moved between its extended and depressed positions, the gap betwen the end of the push bar 20 and the cover member 4 and also between the other end of the push bar 20 and skirt 92 remains small reducing the possibility of an operator being pinched or caught in the gap.

Under some circumstances, it may be desirable to provide the exit device of the present invention with a dogging assembly for maintaining the push bar 20 in its depressed position corresponding to the retracted position of the latch bolt whereupon the door is at all times free to be pulled or pushed to the open position. Such a dogging assembly may include a generally Z-shaped dogging bar 126 which is affixed to the inside of the front cover 62 of the push bar 20 by means of the nut 112 and bolt 110 which also serves to attach the end cover 108 to the front cover 62 of the push bar 20 as shown in FIG. 5. The dogging bar 126 includes at its inner end a latch engaging portion 128 which extends generally parallel to the rear wall 24 of the rear channel member 8. A tail 130 extends inwardly from the inner end of the latch engaging portion 128 of the dogging bar 126.

Various types of dogging devices may be used. In the embodiment shown herein, the dogging device utilizes a lock cylinder 132 which is mounted on the skirt 92 by means of a spacer nut 134 threaded on the lock cylinder 134 into engagement with the inner surface of the skirt 92. A set screw 136 is threaded into the side of the skirt member 92 into engagement with the lock cylinder 132 as shown in FIG. 6. The lock cylinder 132 has a cylinder cam 138 attached to the rotatable core 140 which is turned about the axis of the core when the key 142 is rotated. A dogging cam 144 is threaded onto the lock cylinder 132 and includes a latch portion 146 which is adapted to be engaged by the latch engaging portion 128 of the dogging bar 126 in a manner to be described below. For moving the dogging cam 144, an inwardly extending roll pin 148 or the like, extends from the dogging cam 144 into a position to be engaged by the cylinder cam 138 when the core 140 of the lock cylinder 132 is turned.

If the lock cylinder 132 is actuated without the push bar 20 being depressed, the cylinder cam 138 will move the dogging cam 144 to a point where the latch portion 146 engages the tail 130 on the dogging bar 126. This prevents the latch portion 130 from being positioned inwardly and under the latch engaging portion 128 of the dogging bar 126 which would prevent depression or actuation of the push bar and would prevent the door from opening. When, however, the push bar 20 is depressed before the lock cylinder 134 is actuated, the dogging bar 126 will move to an inward position as shown in FIG. 8 and the dogging cam 144 can then be rotated until the latch portion 146 is positioned over the latch engaging portion 128 of the dogging bar 126 whereby the push bar 20 will be maintained in its depressed position.

The dogging cam 144 is provided with a first stop surface 150 which, when the dogging cam 144 is rotated into its operative position, abuts the arm 36 in the rear channel member 8 to limit the movement of the dogging cam 144 into its operative position. A second stop surface 152 is provided on the edge of the latch portion 146 of the dogging cam 144 which, when the dogging cam 144 is rotated in the opposite direction into its inoperative position, will abut the arm 36 in the rear channel member 8 to limit its movement into the inoperative position.

A wave washer 154 is provided between the dogging cam 144 and the inner end of the spacer nut 134. By threading or unthreading the dogging cam 144 on the lock cylinder 132 when the skirt 92 is removed from the ear channel member 8, the distance between the latch portion 146 and the rear wall of the channel member 8 may be adjusted to ensure that the push bar 20 will be properly depressed when the latch engaging portion 18 engages the latch portion 146. The wave washer 154 puts tension on the dogging cam 144 to prevent inadvertent rotation of the dogging cam 144 on the lock cylinder 132.

Although a cylindrical lock dogging device is shown, other types of dogging devices may be used with the exit device. For example, a hex key actuated device may be used wherein a hex key is used to turn a latch engaging portion into and out of its operative position. All that is required to change the dogging device is to remove the skirt 92 with its attached dogging device and insert another skirt 92 having a different type dogging device. Further, if no dogging device is desired, a plain skirt without any operations may be mounted on the rear channel member 8.

While reference is made above to a specific embodiment of the present invention, it will be apparent to those skilled in the art that various alterations and modifications may be made thereto without departing from the spirit of the present invention. Therefore, it is intended that the scope of this invention be ascertained by reference to the following claims.

What is claimed is:

1. An exit device for a door comprising a rear channel member, a latch bolt assembly at one end of said channel member, a pair of spaced rails mounted in said rear channel member, said channel member including two sets of opposed longitudinally extending grooves in its interior forming tracks for said rails, said rails being mounted in said tracks, a push bar having a portion extending outwardly of said channel member, at least one connecting link pivotable attached at one end to said rails and pivotably attached at the other end to said push bar for mounting said push bar in said channel for movement between a retracted position and a depressed position, said means interconnecting said push bar and said latch bolt assembly to operate said latch bolt assembly when said push bar is moved.

2. The exit device of claim 1 wherein there are at least two connecting links.

3. The exit device of claim 1 wherein each of said rails has a portion bent at right angles, each said bent portion being in engagement with the end of said channel member adjacent the latch bolt assembly, said latch bolt assembly including a portion clamping said bent portions against said end of said channel.

4. The exit device of claim 1 wherein said rear channel member includes a rear wall and opposed side walls extending outward from said rear wall, each side wall having an opposed arm extending toward the interior of said rear channel member, one groove of each set being formed on the inner side of a respective arm and the other groove of each set being formed in the rear wall in opposed relationship to its repective groove on said arm.

5. The exit device of claim 4 wherein each of said arms has a longitudinal flange facing the other, and said push bar includes a pair of flanges facing away from each other and positioned inwardly of said flanges on said arms and in overlapping relationship therewith, and including means biasing said push bar into its extended position wherein said flanges on said push bar are in engagement with the flanges on said arms.

6. The exit device of claim 1 wherein said push bar includes an inwardly opening front channel member including a front wall and spaced side walls extending inwardly therefrom and a front cover attached to the front wall and positioned outwardly therefrom, said connecting link having its other end pivotally attached to said side walls of said front channel.

7. The exit device of claim 1 wherein said rear channel member includes a pair of spaced sidewalls extending outward from the rear wall, said push bar extending only a portion of the length of said channel member, said channel member having a longitudinal extending groove in the interior of each sidewall adjacent the opening of said channel, a skirt member extending from said push bar to the end of said rear channel member opposite said latch bolt assembly, said skirt having flanges thereon on opposite sides received within the grooves in said rear channel member, and an end cap covering the end of said rear channel member opposite said latch assembly.

8. An exit device for doors comprising a rear channel member, a latch bolt assembly at one end of said channel member having a cover thereon, a push bar mounted in said channel member and having a portion extending outwardly therefrom, means connecting said push bar to said channel member for arcuate movement of said push bar relative to said channel member between an extended position and a depressed position, said push bar extending longitudinally from said cover a partial length of said rear channel member, a skirt member mounted in said rear channel member adjacent the opening therein and extending from said push bar to the end of said rear channel member opposite said latch bolt assembly, said push bar having tapered end portions tapering outwardly and toward said latch bolt assembly, said cover including an end portion adjacent said push bar having a taper complementary to said taper on the adjacent end of said push bar, said skirt having a taper at its ends adjacent said push bar complimentary to the taper on the adjacent end of said push bar and an end cover on the end of said rear channel member opposite said latch assembly, said push bar including a front channel member and front cover member attached to said front channel member outwardly thereof, said cover member having sidewalls extending into said rear channel member when said push bar is in its extended position, said cover member being provided with said tapered end portions.

9. An exit device for a door comprising a rear channel member, a latch bolt assembly at one end of said channel member, a push bar mounted in said channel for movement between an extended position and a depressed position, means interconnecting said push bar and said latch bolt assembly to operate said latch bolt assembly when said push bar is moved, said push bar extending from a point adjacent said latch assembly, a partial length of said channel member, a skirt slidably mounted in said channel member and extending from adjacent said push bar to the end of said channel opposite said latch assembly, a stop member mounted in said channel and having a stop surface positioned adjacent the end of said push bar for engagement by the end of said skirt adjacent said push bar, and an end cover covering the end of said channel member and said skirt opposite said latch bolt assembly.

10. The exit device of claim 9 wherein said push bar is mounted for arcuate movement between its extended and depressed positions.

11. The exit device of claim 9 wherein said channel includes a rear wall and outwardly extending opposed sidewalls, each said sidewall having a groove therein in its interior surface adjacent the opening of said channel, said skirt having flanges thereon received within said grooves.

12. An exit device for a door comprising a rear channel member having a rear wall adapted to be mounted against the surface of a door, a latch bolt assembly at one end of said channel member, a push bar mounted in said channel for movement between an extended position and a retracted position, means interconnecting said push bar and said latch bolt assembly to operate said latch bolt assembly when said push bar is moved, said push bar extending from a point adjacent said latch assembly a partial length of said channel member, a skirt slidably mounted in said channel member and extending from adjacent said push bar to the end of said rear channel member opposite said latch assembly, a dogging bar attached to said push bar and extending inwardly in said channel member and having a latch engaging portion extending parallel to the rear wall of said channel member, a dogging device mounted in said skirt and extending inwardly in said channel member, said dogging device including a latch portion extending parallel to said latch engaging portion, means mounting said latch portion for movement between a first position wherein it is free of engagement of said latch engaging portion during movement of said push bar and a second position wherein when said push bar is retracted, said latching portion is positioned outwardly in said channel member of said latch engaging portion and in overlapping engagement therewith.

13. The exit device of claim 12 wherein said dogging bar includes means for preventing said latch portion from being moved into a position to be engaged by said latch engaging portion unless said push bar is in its depressed position.

14. The exit device of claim 13 wherein said means for preventing said latch portion from being moved includes a tail portion extending inwardly in said channel from said latch engaging portion in a position to be engaged by said latch portion before said latch portion is moved to position to be engaged by said latch engaging portion.

15. An exit device for a door comprising a rear channel member having a rear wall adapted to be mounted against the surface of a door, a latch bolt assembly at one end of said channel member, a push bar mounted in said channel for movement between an extended position and a retracted position, means interconnecting said push bar and said latch bolt assembly to operate said latch bolt assembly when said push bar is moved, said push bar extending from a point adjacent said latch assembly a partial length of said channel member, a skirt slidably mounted in said channel member and extending from adjacent said push bar to the end of said rear channel member opposite said latch assembly, a dogging bar attached to said push bar and extending inwardly in said channel member and having a latch engaging portion extending parallel to the rear wall of said channel member, a lock cylinder mounted in said skirt and extending inwardly in said channel member, a dogging cam threaded on said lock cylinder and including a latch portion extending parallel to said latch engaging portion, a cylinder cam on said cylinder lock and rotatable about an axis means on said dogging cam for engagement by said cylinder cam upon rotation thereof in one direction to rotate said dogging cam on said cylinder into a first position where it is free of engagement of said latch engaging portion during movement of said push bar and upon rotation in another direction into a second position wherein when said push bar is retracted, said latch portion is positioned outwardly in said channel member of said latch engaging portion and in overlapping engagement therewith.

16. The exit device of claim 15 further including means for putting tension on said dogging cam to prevent inadvertent rotation thereof relative to said lock cylinder.

17. The exit device of claim 16 wherein a spacer washer is threaded on said cylinder lock into engagement with the inner side of said skirt and said means for putting tension is a wave washer positioned between said dogging cam and said washer.

18. The exit device of claim 15 wherein said dogging bar includes means for preventing said latch portion of said dogging cam from being moved into a position to be engaged by said latch engaging portion unless said push bar is in its depressed position.

19. The exit device of claim 18 wherein said means for preventing said latch portion from being moved includes a tail portion extending inwardly in said rear channel member from said latch engaging portion in a position to be engaged by said latch portion upon rotation of said dogging cam before the latch surface thereof is in position to be engaged by the latch enaging surface.

20. The exit device of claim 19 wherein said camming dog has a first stop surface for engaging a surface in its interior of said rear channel member when said dogging cam is in its first position and a second stop surface for engaging a surface in said rear channel member when said dogging cam is in its second position.

* * * * *